United States Patent [19]

Scalera et al.

[11] 4,176,762

[45] Dec. 4, 1979

[54] DRIVE SYSTEM FOR ROTARY MERCHANDISE CARRIERS

[76] Inventors: Frank T. Scalera, 12 Bowdoin St., Maplewood, N.J. 07040; Merrill Krakauer, 1 Deer Path, Short Hills, N.J. 07078

[21] Appl. No.: 926,001

[22] Filed: Jul. 19, 1978

[51] Int. Cl.[2] ..... G07F 11/00

[52] U.S. Cl. ..... 221/81; 221/121; 221/129

[58] Field of Search ..... 221/79, 80, 81, 82-86, 221/119-122, 126-129, 76

[56] References Cited

U.S. PATENT DOCUMENTS 4,087,020 5/1978 Krakauer ..... 221/84

*Primary Examiner*—Allen N. Knowles

*Attorney, Agent, or Firm*—Shenier & O'Connor

[57] ABSTRACT

An improved drive system for a merchandising machine having a plurality of removable modules each including an upper and a lower rotary merchandise carrier adapted to be driven successively to position the compartments thereof adjacent to an escrow mechanism actuated in response to movement of the carrier first to release an article and then to receive an article from a compartment positioned adjacent thereto, each unit having a product pusher adapted to be moved into a positioned compartment positively to force an article out of the compartment to the escrow mechanism, said drive system including a plurality of sliders mounted on the modules adjacent to the respective carriers for vertical reciprocating movement to carry a drag link having a pawl thereon along a path defined by cam and follower means successivly to step the carrier through a distance equal to the extent of one compartment and then to operate said pusher. The drive system includes a vertically reciprocating frame mounted on the module receiving cabinet which frame moves upwardly with a dwell for product delivery and which carries a plurality of selectively actuatable plates each of which is movable between an inactive position at which it clears its associated slider as the frame moves upwardly and an active position at which it engages its associated slider as the frame moves upwardly to drive the corresponding merchandise carrier and to operate the corresponding pusher.

10 Claims, 9 Drawing Figures

FRAME LIFT
3
2
1
0
90°
180°
270°
360°
SHAFT ROTATION 266
268
270
194
196
170
200
1R
2R
3R
4R
R
S1
S2
S3
S4
224a
224b
224c
PS1
PS2
PS3
PS4
272
274
276
278
280

DRIVE SYSTEM FOR ROTARY MERCHANDISE CARRIERS

BACKGROUND OF THE INVENTION

Our invention relates to the field of merchandising machines and more specifically to an improved drive system for an article dispensing merchandising machine having generally circular article supply carriers adapted to be driven on each operation of the machine to deliver an article of merchandise.

U.S. Pat. No. 4,087,020 issued May 2, 1978, to Merrill Krakauer, for ARTICLE VENDING MACHINE HAVING ROTARY STORAGE COMPARTMENTS discloses a merchandising machine including a plurality of merchandise storage and delivery modules mounted for movement on the machine cabinet between a housed position in the machine cabinet and a position at which the units are out of the cabinet to facilitate loading thereof. Each module includes an upper and a lower storage and delivery unit, each of which includes a generally circular merchandise supply carrier adapted to be stepped through a distance corresponding to one compartment of the carrier in the course of a delivery operation to position a compartment thereof adjacent to the inlet of an escrow display assembly, having a display surface and a door structure made up of a lower door and an upper door. In response to a step of movement of a carrier, the associated door structure moves to cause the lower door to release an article from the display shelf and the upper door to prevent the next article from falling onto the display surface. When the article has been dispensed, the door structure closes the bottom of the escrow surface and permits the next article to move onto the surface. In addition, each unit includes a product pusher adapted to be actuated to move into a compartment positioned adjacent to the escrow system positively to move the product out onto the escrow surface.

The machine described in the patent cited hereinabove includes a drive system for selectively operating the units of the machine successively to step the merchandise carrier and thus operate the escrow mechanism and then to operate the pusher to cause it to move into the compartment positively to force an article out into the escrow mechanism. More specifically, respective upper and lower carriages are mounted for swinging movement adjacent to the upper and lower units of the machine. Each carriage supports a plurality of selectively actuatable members, each of which includes a "T" head. In the inactive position of each of these selector members, the "T" heads ride idly by their associated units. In the active position of a "T" head, as its associated carriage swings with relation to the corresponding unit, one side of the "T" head enters a cam track to guide the head along such a path that the other side of the "T" head first releases a unit locking pawl and then engages a tooth on the carrier to rotate the member through a distance corresponding to one compartment and then to drive the product pusher.

While the drive system shown in the cited patent functions satisfactorily, it incorporates a number of defects. First, it requires that the delivery units be relatively accurately located relative to the selecting elements, when the modules are moved back into the cabinet after loading of their units. Secondly, the swinging motion of the carriage as it drags the "T" head along the cam path, requires that the parts be built up to a point at which they are excessively bulky and weighty. Thirdly, the mechanism for selectively actuating the coupler elements and for releasing the coupler elements is relatively complicated. Further, any mid-cycle jam requires dismantling of the machine.

We have invented an improved drive system for a merchandising machine of the type employing rotatable merchandise carriers. Our improved drive system is simpler in construction than are drive systems of the prior art employed in machines having rotary merchandise storage compartments. It is more rugged than such drive mechanisms of the prior art and has a longer life. It is more certain in operation than are systems of the prior art adapted selectively to rotate generally circular merchandise carriers. Mid-cycle jams can be cleared without dismantling the machine.

SUMMARY OF THE INVENTION

One object of our invention is to provide an improved drive system for a merchandising machine having circular merchandise carriers, which is simpler in construction than are drive mechanisms of the prior art employed in such machines.

Another object of our invention is to provide an improved drive system for a merchandising machine having circular merchandise carriers which drive system is more rugged than are drive systems of the prior art employed in such machines.

A further object of our invention is to provide an improved drive system for a merchandising machine having circular merchandise carriers, which drive system has a longer life than do drive systems of the prior art which have been employed in such machines.

A still further object of our invention is to provide an improved drive system for a merchandising machine having generally circular merchandise carriers, which drive system is more certain in operation than are drive systems of the prior art employed in such machines.

Other and further objects of our invention will appear from the following description.

In general, our invention contemplates an improved drive system for a merchandising machine having a cabinet with a plurality of modules supported for movement from housed positions to loading positions at which respective upper and lower merchandise storage and delivery units of the modules are accessible for loading. Each unit is adapted to be driven successively to position the merchandise storage compartments thereof adjacent to an escrow mechanism actuated in response to movement of the carrier first to release an article and then to receive an article from a compartment positioned adjacent thereto, each unit having a product pusher adapted to be moved into a positioned compartment positively to force an article out of the compartment to the escrow mechanism. Our drive system includes a plurality of slides mounted on the modules adjacent to the respective carriers for vertical reciprocating movement to carry a drag link having a pawl thereon along a path defined by cam and follower means successively to step the carrier through a distance equal to the extent of one compartment and then to operate said pusher. Our drive system includes a virtually reciprocating frame mounted on the module receiving cabinet which frame moves upwardly with a dwell for product delivery and which carries a plurality of selectively actuatable plates, each of which is movable between an inactive position at which it clears its associated slider as the frame moves upwardly and an active position at which it engages its associated slider as the frame moves upwardly to drive the corresponding merchandise carrier and to operate the corresponding pusher.

BRIEF DESCRIPTION OF THE DRAWINGS

In the accompanying drawings, to which reference is made in the instant specification, and in which like reference characters are used to indicate like parts in the various views.

DESCRIPTION OF THE PREFERRED EMBODIMENT

Figure 1:
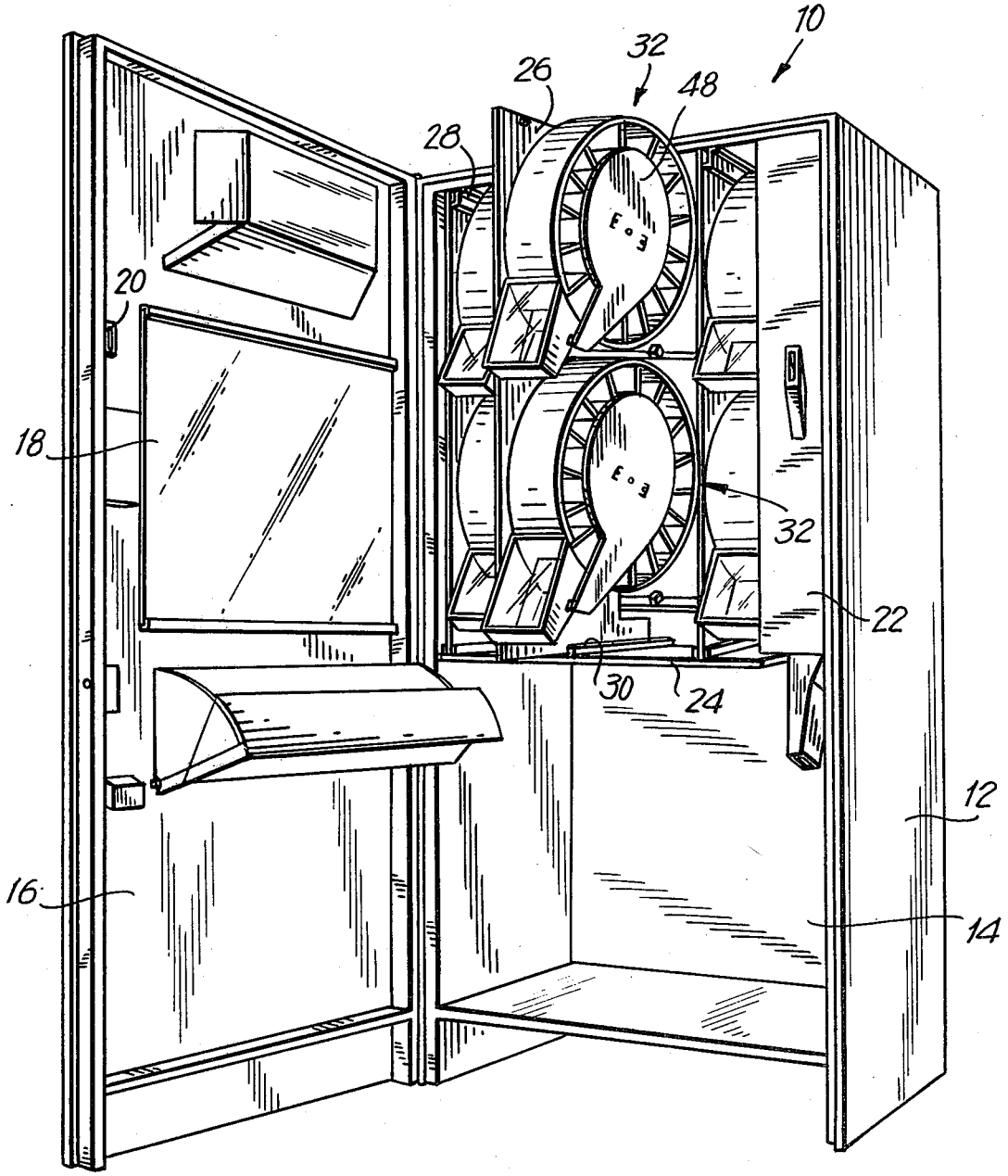
FIG. 1 is a perspective view of a merchandising machine incorporating our improved drive mechanism.

Referring now to FIG. 1 of the drawings, a machine indicated generally by the reference character 10, which is provided with our improved drive mechanism, includes a cabinet 12 having a back 14 and a door 16 provided with a window 18 through which articles of merchandise adapted to be vended next by the various units of the machine can be seen. A coin slot 20 in the door 16 permits coins to be inserted into the coin mechanism 22 supported in the machine cabinet.

A generally horizontally extending platform or partition 24 divides the cabinet 12 into upper and lower spaces. The machine 10 includes a plurality of generally vertically extending panels 26, the upper and lower edges of which are received in guides 28 and 30 for movement of the panels outwardly of the machine to loading positions and to housed positions within the cabinet. Each of the panels 26 supports an upper and lower merchandise delivery unit, each of which is indicated generally by the reference character 32. Each of the panels 26 and the delivery units carried thereby makes up a module of our merchandising machine.

Figure 2:
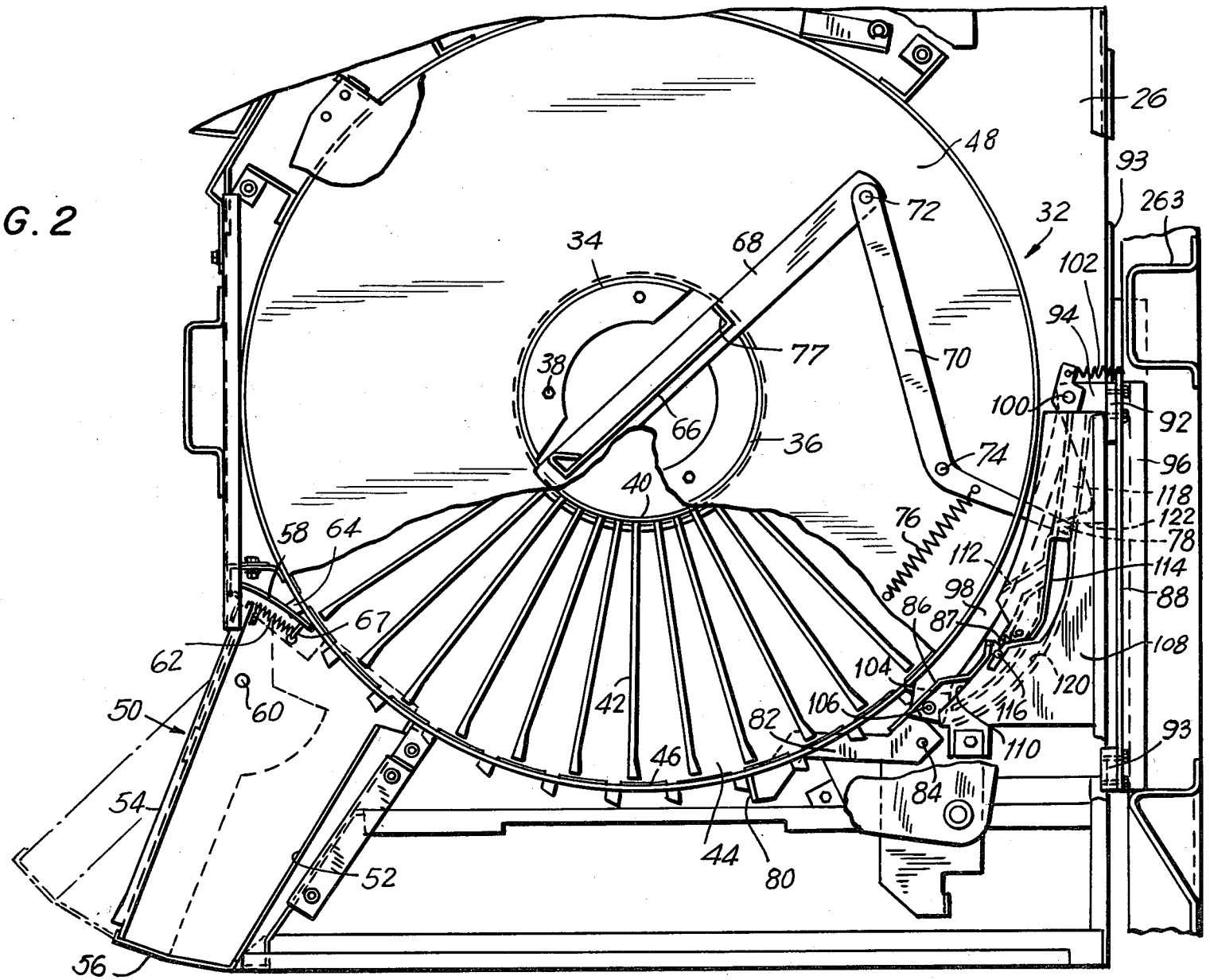
FIG. 2 is a fragmentary side elevation of one of the delivery units of the merchandising machine illustrated in FIG. 1 with parts broken away.
Figure 3:
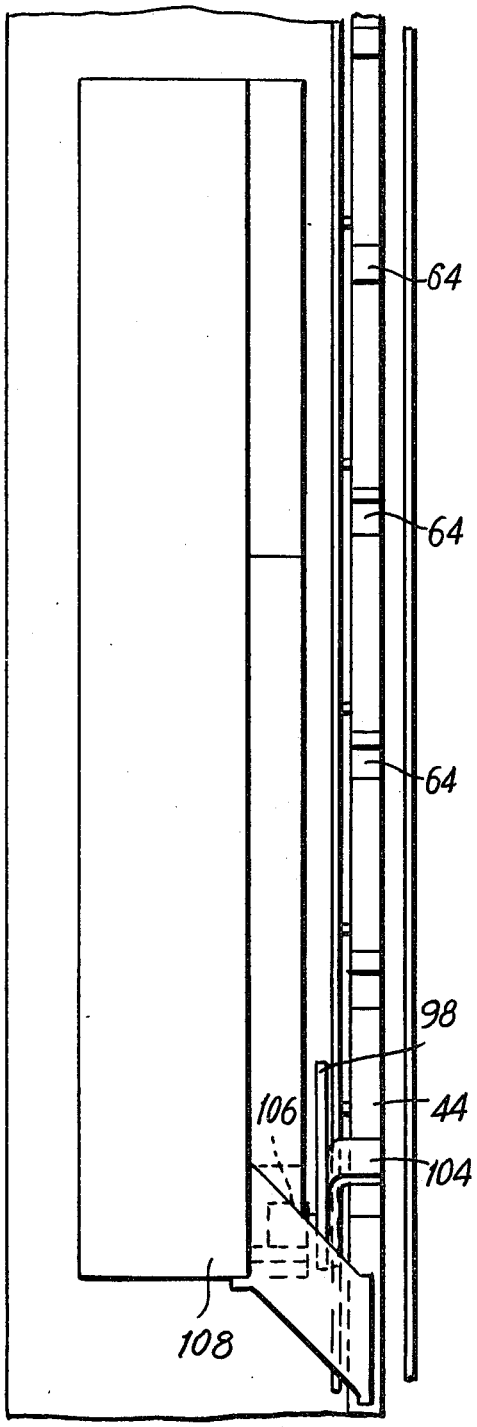
FIG. 3 is a fragmentary elevation of the unit shown in FIG. 2.

Referring now to FIG. 2, a panel 26 carries a pair of bearing members 34 and 36 secured thereto by screws 38 or the like, which receive the hub 40 of the merchandise carrier of a unit 32. A plurality of circumferentially spaced radially outwardly extending partitions 42 on a plate 44 carried by the hub 40 define the merchandise receiving compartments of the unit 32. A stationary shroud 46 surrounds the merchandise carrier of the unit over substantially its entire periphery save for the location at which articles of merchandise are to be delivered. Each unit further is provided with a cover 48 which normally closes the open sides of the compartments formed by the partitions 42.

Each unit 32 includes an escrow subassembly, indicated generally by the reference character 50, to which articles of merchandise are delivered one by one from the merchandise carrier. Assembly 50 includes a surface 52 on which the article next to be delivered rests so as to be visible to a potential customer through the window 18 and through a transparent cover 54 forming part of the unit 50. Each unit 50 includes a lower door 56 which normally closes the bottom of the escrow compartment and an upper door 58. These two doors are pivoted for movement as a unit above a pivot 60. A spring 62 normally urges the door assembly to a position at which the lower door 56 closes the bottom of the escrow compartment. When the merchandise carrier is stepped in a counterclockwise direction in a manner to be described, one of a plurality of teeth 64 on the periphery of plate 44 engages a projection 67 on the door assembly to rotate the door assembly in a clockwise direction as viewed in FIG. 2 to move door 56 away from the bottom of the compartment to permit the article next to be dispensed to fall into the delivery tray assembly on the door 16. At the same time, the upper door 58 moves to a position at which it prevents an article from a compartment coming into registry with the upper end of the escrow assembly from moving onto the surface 52 until the door assembly returns to its initial position. The construction and operation of the escrow assembly 50 is more fully described in U.S. Pat. No. 4,087,020 referred to hereinabove.

Each of the units 32 also includes an ejector or pusher 66 which extends into the space between members 34 and 36 from a slide 68 disposed behind the plate 44 as viewed in FIG. 2. A pin 72 connects one bell crank arm 70 to the slide 68. A pin 74 supports the bell crank for pivotal movement on the panel 26. A spring 76 normally urges the bell crank to a position at which a stop limits the clockwise movement thereof. The other arm 78 of the bell crank is adapted to be engaged in a manner to be described to drive the bell crank in a counterclockwise direction as viewed in FIG. 2 to force the pusher or ejector 66 into the compartment which is in alignment with the upper end of the escrow assembly 50 after the door assembly has returned to its initial position positively to push the article out of the compartment and onto the surface 52. The action of the ejector just described is more fully pointed out in the patent referred to hereinabove.

A stop 80 carried by a lever 82 supported on a pivot pin 84 normally is in the path of a tooth 64 under the action of a spring 87 connected to an actuator flange 86 on lever 82 so as to prevent accidental counterclockwise rotation of the merchandise carrier.

Our improved drive assembly includes a vertically extending slide bar 88 supported for sliding movement on a track 93 at the back of the panel 26 by means of suitable blocks 92 and 93 or the like. Slide bar 88 carries a slider 94 which extends inwardly from the back of the panel 26. The underside of a vertically extending flange 96 on bar 88 is adapted to be engaged in a manner to be described to move the slider 94 upwardly.

A pivot pin 100 on the slider 94 supports a drag link 98. A spring 102 normally urges the drag link 98 to move in a clockwise direction around the pivot 100 to bring a pawl 104 on the lower end of the link 98 into engagement with the periphery of the plate 44. A roller 106 at the lower end of the link 98 moves along a path to be described hereinafter to perform certain operations in sequence under the action of cam tracks formed in a casting 108 secured to the panel 26.

As the slider 94 moves upwardly, roller 106 moves along the under surface of the actuator flange 86 to pivot lever 82 in a counterclockwise direction as viewed in FIG. 2 to move the stop 80 out of the path of a tooth 46. At a predetermined point in the course of this movement, pawl 104 engages a tooth 64 of the plate 44 to rotate the compartment in a counterclockwise direction as viewed in FIG. 2. In the course of this movement, an "up" cam track portion 110 on casting 108 controls the movement of roller 106 to hold the pawl 104 in engagement with the tooth 64. Finally, the roller 106 comes into engagement with a guide 112 which swings the drag link 98 in a counterclockwise direction as viewed in FIG. 2 to move the pawl 104 out of engagement with the tooth 64. Roller 106 continues to follow the guide 112 until it encounters a gate 114 in the form of a leaf spring secured to the casting by a screw 116. Gate 114 normally closes the upper end of the space between guides 110 and 112. After the roller passes the gate, it continues its movement upwardly along an upper path portion 118. In the course of this movement, pawl 104 engages the arm 78 of the bell crank to move the pusher or ejector 66 into the compartment positioned above the escrow assembly positively to move an article out of the compartment and onto the shelf 52. When the movement of slider 94 reverses, roller 106 returns to its initial position along a track 120 formed in the casting 108. Further, in the course of this movement, a foot 122 on the slider 94 positively ensures return of the pusher 66 in the event that for any reason it tends to remain in the carrier compartment.

Figure 5:
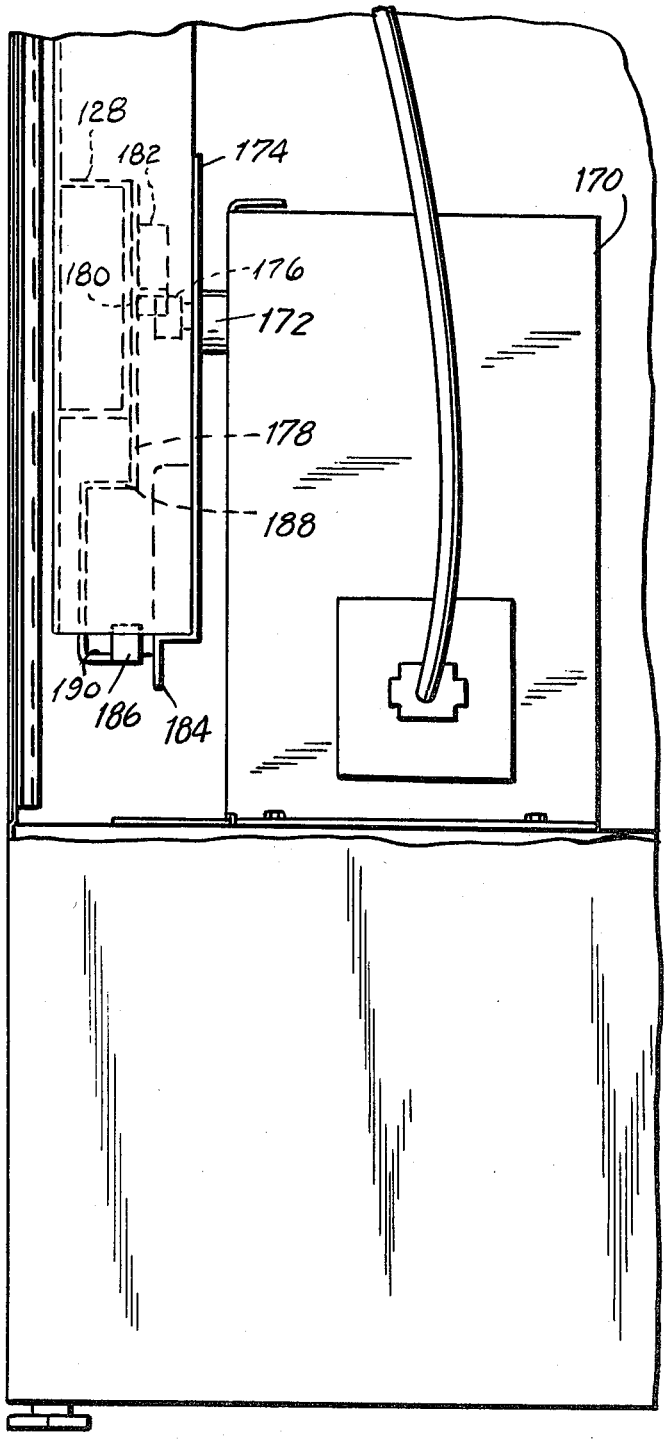
FIG. 5 is a fragmentary sectional view of a portion of the mechanism shown in FIG. 4 taken along the line 5—5 in FIG. 4.
Figure 4:
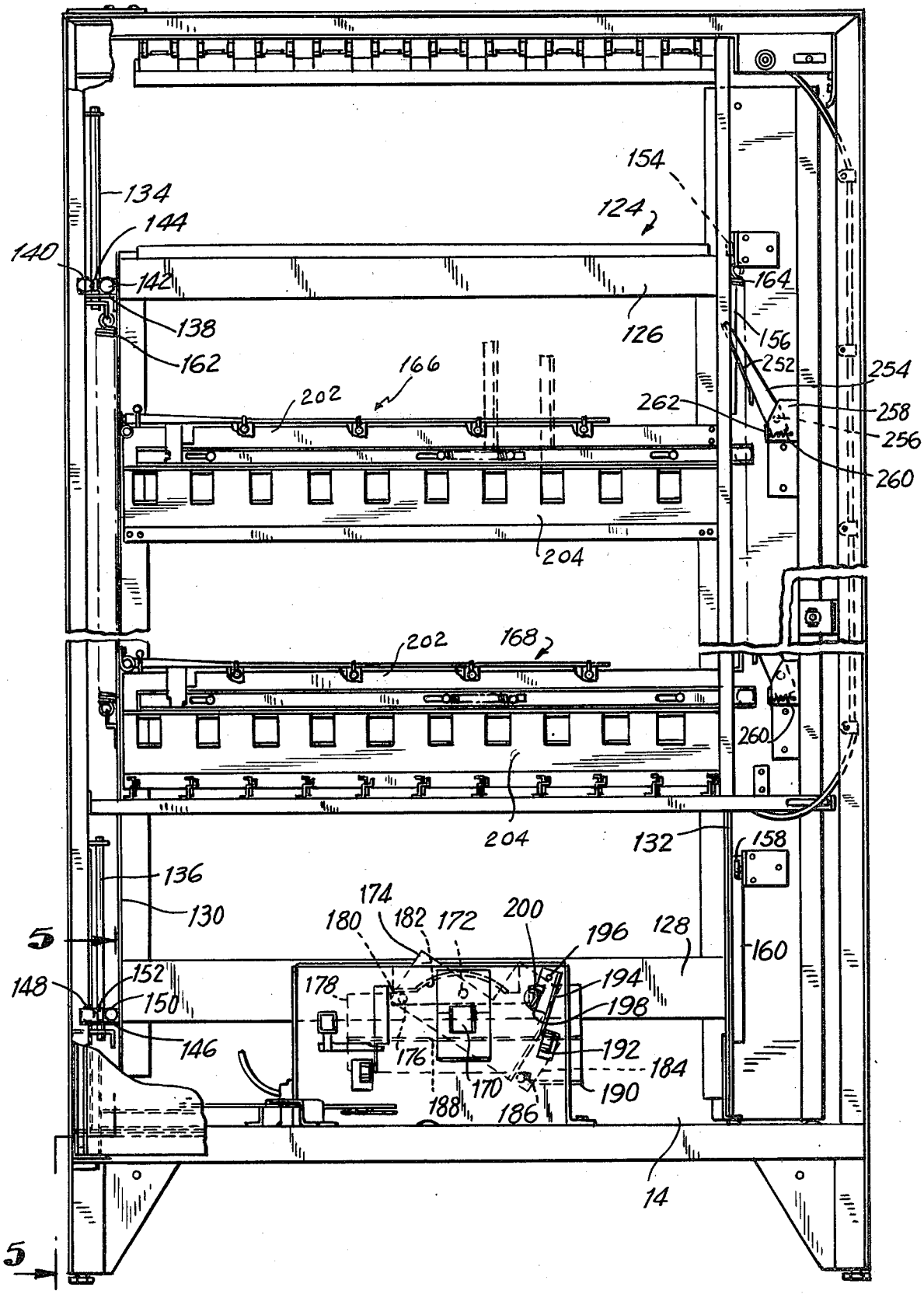
FIG. 4 is a front elevation of a portion of our improved drive mechanism.

Referring now to FIGS. 4 and 5, our improved drive mechanism includes a generally rectilinear frame, indicated generally by the reference character 124, having a top cross piece 126, a bottom cross piece 128, and sides 130 and 132. Respective brackets or the like support an upper guide rod 134 and a lower guide rod 136 at the left-hand side of the machine cabinet as viewed from the front. An upper guide roller bracket 138 on the frame 124 supports a pair of upper lateral guide rollers 140 and 142 between which the rod 134 extends. An upper retainer roller 144 on bracket 138 is disposed in front of the upper guide rod 134. A lower guide roller bracket 146 supports a pair of spaced lower lateral guide rollers 148 and 150 with rod 136 extending through the space between the rollers. A lower left-hand retaining roller 152 on bracket 146 is disposed in front of the rod 136.

An upper right-hand retaining roller 154 supported by a bracket on the cabinet is adapted to engage a vertically extending flange 156 on the frame 124. Similarly, a lower right-hand retaining roller 158 carried by a bracket secured to the cabinet is adapted to engage a vertically extending flange 160 on the frame 132.

A pair of springs 162 and 164 extending between brackets on the machine cabinet and brackets on the frame 124 support the major portion of the weight of the frame 124 so as to permit it to be driven in a manner to be described with relatively little expenditure of power. The frame 124 supports an assembly 166 of upper unit control and selection devices and an assembly 168 of lower storage unit control and selection devices, which devices will more fully be described hereinbelow.

Figure 9:
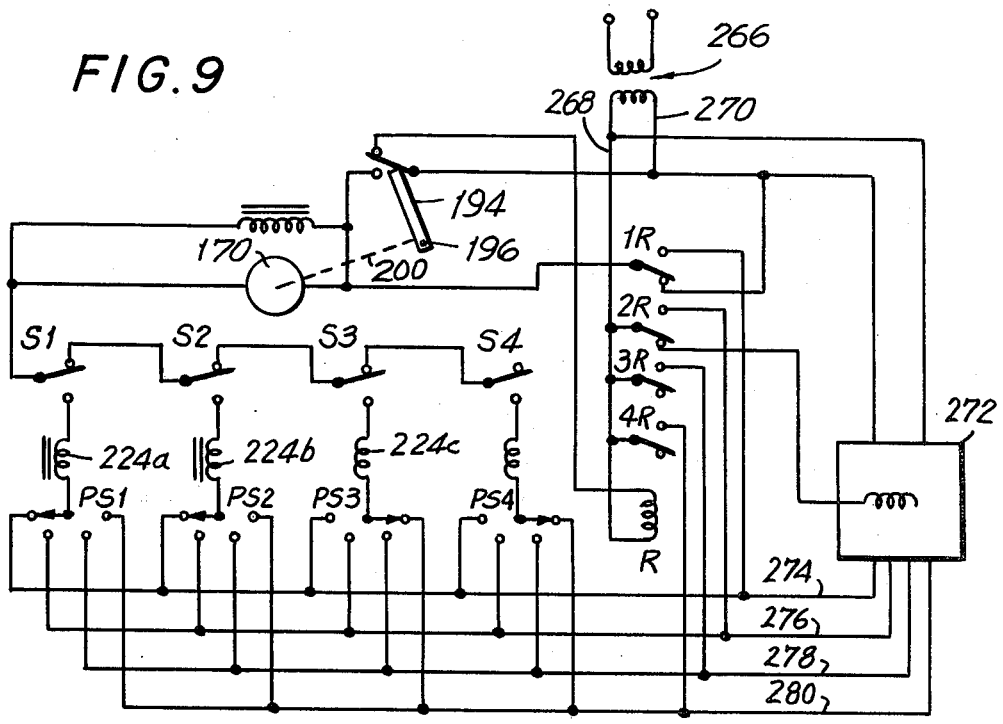
FIG. 9 is a schematic view illustrating one form of electrical circuit which can be used with a merchandising machine provided with our improved drive mechanism.

A drive motor 170 supported on the cabinet is adapted to drive a shaft 172 carrying a plate 174 of irregular configuration. Plate 174 carries a first drive roller 176 which, as shaft 172 rotates in a clockwise direction as viewed in FIG. 4, cooperates with a fast start track portion 180 during approximately the first fifty degrees of rotation of shaft 172 and then cooperates with a dwell cam surface portion 182 up to about one hundred and thirty degrees of rotation of the shaft 172. Both of the cam track portions 180 and 182 are formed on a track member 178 secured to the crossbar 128 by any suitable means such as by welding or the like. An offset 184 on the plate 174 carries a second roller 186 which is adapted to engage an offset 188 in the track member 178 at about one hundred and thirty degrees of rotation of shaft 172 and to drive the frame with simple harmonic motion until a full revolution is completed. The track member 178 carries a flange 190 which is adapted to be engaged by roller 186 to provide a positive return for the frame in the event that the frame for any reason sticks. In FIG. 9, we have diagrammatically illustrated the motion of the frame with relation to a full cycle of shaft 172.

Our apparatus includes a one-revolution switch 192 which is adapted to be held open by a flange 194 pivotally supported on a pin 196 when an offset 198 on the flange arm is engaged by an element 200 on the plate 174 when the plate is in its home position. When the plate moves out of its home position, switch 192 is permitted to close until the shaft 172 makes a full revolution.

Figure 6:
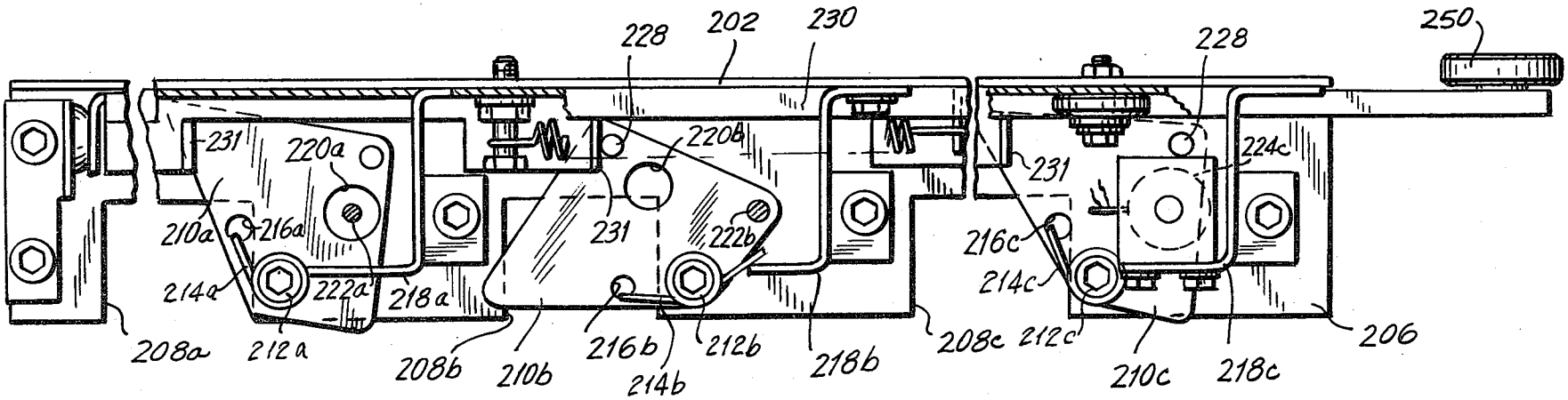
FIG. 6 is a fragmentary sectional view of the slide coupling assembly of our improved drive mechanism.
Figure 7:
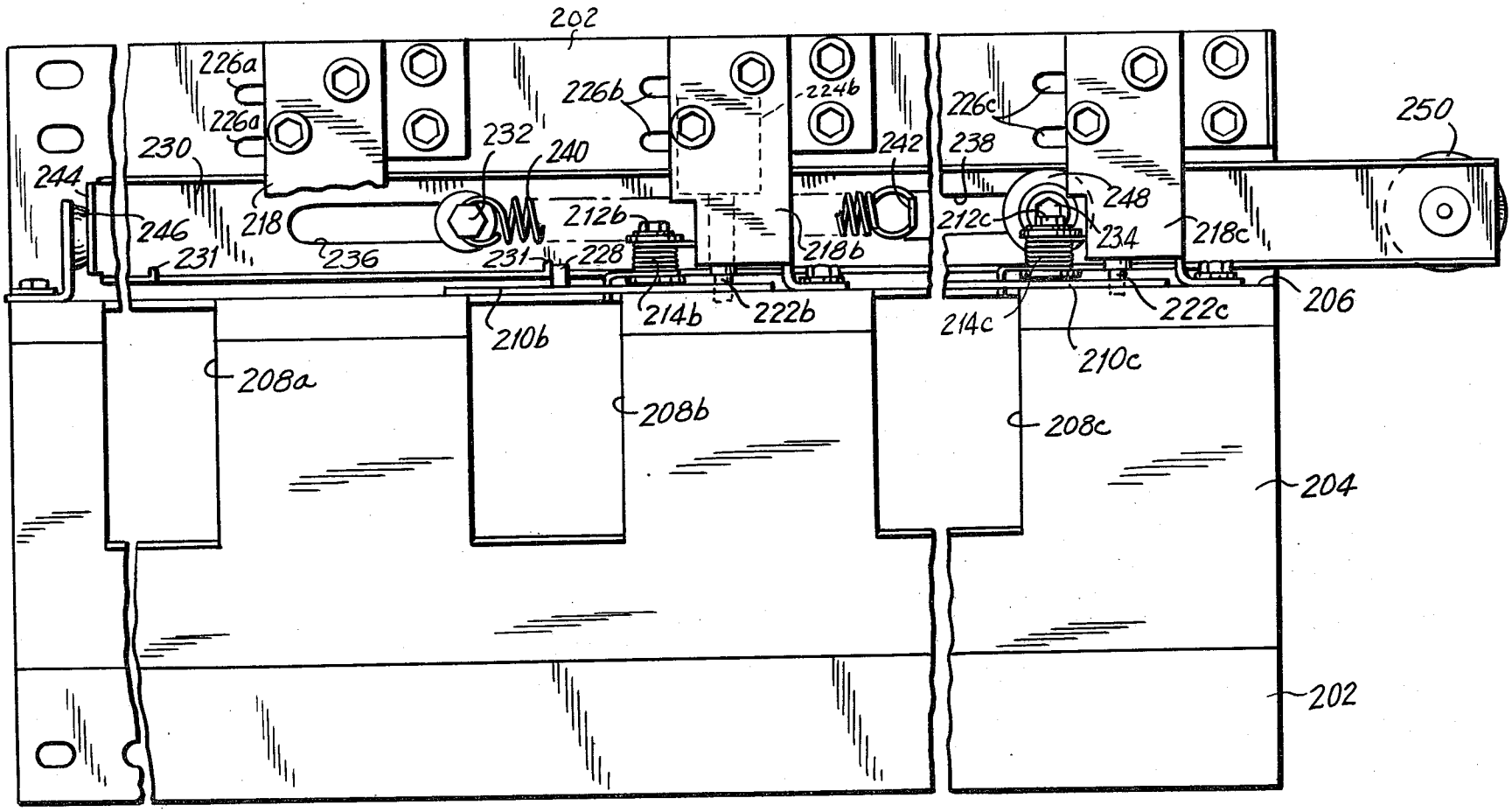
FIG. 7 is a front elevation of the mechanism illustrated in FIG. 6.

Referring now to FIGS. 4, 6 and 7, each of the assemblies 166 and 168 includes a member 202 formed of sheet metal and extending across the frame 124 with the ends of the member 202 secured to the verticals 130 and 132 by any suitable means such as by screws or nuts and bolts or the like. We form the member 202 with an outwardly extending bend 204 so as to provide a platform 206. In addition, we cut the member 202 at spaced locations along the length thereof corresponding to the locations of the various delivery units with which the member is associated to form openings 208*a*, 208*b*, 208*c*, etc., in the platform 206. Respective drive plates 210*a* to 210*c*, etc., associated with the respective delivery units are supported on pivot pins 212*a* to 212*c*, etc., for movement between retracted positions at which the openings 208 are clear and operative positions at which they block their corresponding openings. Each of a plurality of respective springs 214*a* to 214*c* bears with one end against a solenoid support bracket 218. The other end of each spring is bent and is inserted in a hole 216 in the plate 210 normally to urge the plate to rotate in a counterclockwise direction as viewed in FIG. 6 to a position at which the plate blocks the opening 208.

We form each of the plates 210 with a hole 220*a* adapted to receive a solenoid pin 222*a* to hold the plate 210 in its retracted position against the action of its associated spring 214. Each of the plates 210 further carries a reset pin 228.

A reset bar 230 is provided with a plurality of spaced upstanding lugs 231 which are adapted to be engaged by the reset pins 228 in the operative position of the drive plates 210. Respective pins 232 and 234 carried by the member 202 are received in spaced slots 236 and 238 formed in the reset bar 230. A spring 240 extending between a tab 242 on the reset bar and the pin 232 normally urges the bar to move to the left as viewed in FIGS. 4, 6 and 7, until an end flange 244 thereon engages a stop pad 246. The right-hand end of each of the reset bars 230 carries a reset bar drive roller 250.

Our apparatus includes means for acting on the drive roller 250 to move the reset bar 230 to the right as viewed in FIGS. 4, 6 and 7, to cause an actuated plate 210 to be restored to its initial position at which the pin 222 will again move into the opening 220 under the action of the solenoid return spring (not shown). As the frame 124 moves upwardly as viewed in FIG. 4, each of the reset bar drive rollers 250 engages the underside of a reset flange 252 carried by an arm 254 pivotally supported on a pin 256 on a bracket 258 in the cabinet. A spring 260 urges each of the arms 254 to the full line position shown in FIG. 4. As the roller 250 engages the flange 252, it rotates the arm 254 in a clockwise direction against the action of spring 260 until the roller rides past the flange and spring 260 restores the arm 254 to its initial position. When, now, frame 124 moves downwardly, each of the rollers 250 rides onto the upper surface of its associated flange 252 to attempt to rotate arm 254 in a counterclockwise direction as viewed in FIG. 4. Owing to the engagement of a tab 262 with the edge of bracket 258, the arm is prevented from rotating. Thus, as the frame continues to move downwardly, the inclination of the flange 252 to the vertical causes the reset bar 230 to move to the right as viewed in FIGS. 4, 6 and 7, until the roller passes by the end of flange 252 at which time the spring 240 is permitted to return the reset bar to its initial position. In the course of its movement to the right, the lugs 231 on bar 230 engage a pin 228 of the actuated plate 210 to restore the plate to its initial position so that the machine is ready for its next operation.

As is pointed out hereinabove, the drive system for frame 124 includes an offset 190 which is adapted to be engaged by the roller 188 to provide a positive downward movement of the frame. This action likewise will produce a positive downward movement on any slide which has been actuated. This will result from the action of the upper cross piece 126 on the top of an upper slide flange and by the action of an intermediate cross piece 263 on the upper end of any actuated lower slide flange.

Referring now to FIG. 9, one form of electrical control circuit which can be used to control our merchandising machine drive system, includes a transformer 266 adapted to supply power to lines 268 and 270. These lines provide the power for a coin mechanism 272 of any suitable type known to the art adapted to produce signals on output lines 274, 276, 278, and 280 in response to the deposit in the mechanism of various sums in money. Respective price selection switches PS1 to PS4 selectively connect one of the price lines to a respective solenoid **224*a* to 224*d* to establish a price for the particular unit of the machine. The machine further includes selection switches S1 to S4, which are adapted to be actuated to energize the solenoid winding and to energize motor 170, as well as a delivery door locking solenoid DS. When this occurs, the circuit for the motor and for the door solenoid is maintained for a single revolution. At the same time, the synchronizing relay winding R is de-energized to cause its contact arms to move to positions at which the selecting switches are disabled and the coin mechanism 272** is bypassed.

Figure 8:
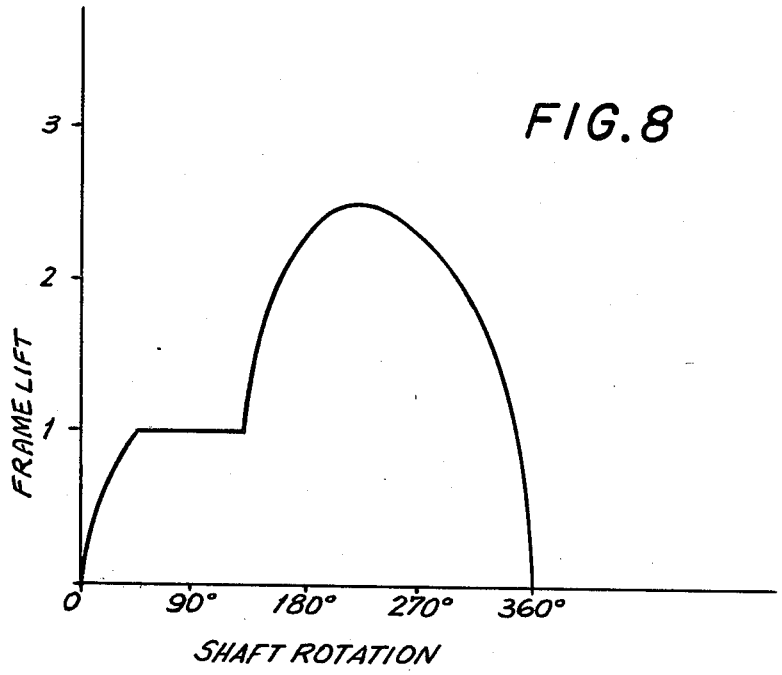
FIG. 8 is a diagram illustrating the motion of a portion of our improved drive mechanism.

In operation of our improved drive mechanism for a merchandising machine employing circular drive compartments, when a selection is made by pushing a switch S1 to S4, corresponding to a unit for which at least the price of an article contained therein has been deposited in the mechanism 272, the associated solenoid **224*a* to 224*d* is energized to move its pin 222*a* upwardly as viewed in FIG. 7 to release the corresponding plate 210, such for example as is indicated by plate 210*b* in FIG. 6. In this position of the plate 210*b*, it will engage the lower edge of the corresponding slide bar flange 96 as the frame 124 moves upwardly. At the same time, motor 170 is energized to drive its shaft 172 to cause follower 176 first to engage surface 180. When this occurs and for about the first fifty degrees of rotation of the shaft as indicated in FIG. 8, the frame 124 moves relatively rapidly upwardly. In the course of this movement of the frame, surface 110 holds roller 106 in such a position that the roller first moves under flange 86 to rotate lever 82 in a counterclockwise direction as viewed in FIG. 2 to release the lock 80. As the roller 106 continues to move along the surface 110, it is brought into engagement with a tooth 64 on the plate 44, so as to drive the plate through a distance equal to the space occupied by one of the compartments of the carrier. As this occurs, a tooth on plate 44 operates the door assembly of the escrow mechanism 50 to open the lower end thereof to permit an article to fall to the delivery tray. During this time, the upper end of the escrow assembly is closed to prevent an article from the compartment coming into position for moving onto the display surface 52. When the carrier has completed a step of revolution, the door assembly returns to its initial position and the article of the compartment which has moved into position adjacent to the escrow mechanism should move onto the shelf 52. For the next approximately eighty degrees of movement of the shaft 172, roller 176 rides along surface 182 and the frame 124 dwells for a sufficient period of time to ensure delivery of the product from the escrow shelf. Next, the roller 186 takes over and engages track portion 188 to continue the upward movement of the frame 124 until about two hundred and twenty degrees of rotation of the shaft 172. In the course of this movement, the pawl 104 on the drag link 98 engages arm 78 to operate the product pusher mechanism to move the pusher into the compartment positioned adjacent to the escrow mechanism to ensure that an article moves out of the compartment onto the escrow surface 52**.

It will further be appreciated that in the course of this movement, roller 106 moves past the one-way gate 114 so that in returning to its initial position it moves along guide 120. In the course of the return movement of the frame 124, roller 188 can engage the surface 190 to provide a positive return for the frame if for any reason there is a hangup, so that the upper frame cross piece 126 or the intermediate cross piece 263 will engage the upper end of the flange 96 associated with an actuated slider positively to move the slide downwardly. Moreover, as the slide moves downwardly, if for any reason the escrow mechanism sticks in the compartment positioned adjacent to the escrow assembly 50, foot 122 acts on lever end 78 positively to restore the product pusher assembly to its initial postion. When all this has occurred, the machine is ready for the next operation.

It will be seen that we have accomplished the object of our invention. We have provided an improved drive mechanism for a merchandising machine of the type employing circular merchandise carrier compartments. Our improved drive mechanism is simpler than are drive mechanisms of the prior art used with circular merchandising carriers. Our improved drive mechanism is rugged. It has a long life. It is certain in operation.

It will be understood that certain features and subcombinations are of utility and may be employed without reference to other features and subcombinations. This is comtemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. In a merchandising machine having a plurality of merchandising units each of which includes a display escrow assembly adapted to be actuated to deliver an article held thereby and a rotary merchandise carrier provided with a plurality of storage compartments and adapted to be driven to position a compartment thereof adjacent to said escrow assembly to which an article can move out of said storage compartment and means responsive to rotation of said carrier for actuating said escrow assembly and a product pusher adapted to be moved into a compartment positioned adjacent to said escrow means, an improved drive system including a plurality of sliders, means mounting said sliders adjacent to the respective carriers for movement with an upward stroke and with a return stroke, respective drag links carried by said sliders, an element on each of said links adapted to engage its associated carrier to rotate the same and to operate the corresponding pusher, means for constraining an element to move along a first path in which it successively rotates its associated carrier and operates its associated pusher in the course of the upward movement of the corresponding slider and to move along a second path in which it ensures return of its associated pusher and clears its associated carrier in the course of the return movement of the corresponding slider, a drive member, means mounting said drive member for vertical linear reciprocating movement adjacent to said sliders, normally inoperative interengageable means on said sliders and on said member, means for selectively rendering said interengageable means operative, and means for driving said member with a dwell between the time said carrier rotates and said pusher is actuated.

2. In a merchandising machine having a plurality of rotary merchandise carriers and means responsive to rotation of a carrier for delivering an article of merchandise from a compartment of said carrier and a plurality of product pushers associated with said carriers and each adapted to be actuated to move into a compartment of said carrier positively to move an article out of said compartment, an improved drive system for selectively rotating said carriers and for actuating the product pusher associated with a rotated carrier including in combination, a plurality of sliders, means mounting said sliders respectively adjacent to said carriers and for vertical reciprocating movement relative thereto, a plurality of drag links, means mounting said links respectively on said sliders, respective actuating elements on said drag links, means responsive to movement of a slider for guiding a link to cause the actuating element thereof successively to rotate the associated carrier and to actuate the associated pusher, a drive member, means mounting said drive member adjacent to said sliders for vertical reciprocating movement, a plurality coupling elements, means mounting each of said coupling elements on said member in association with said sliders and for movement between an inactive position at which it clears its associated slider upon movement of said member and an active position at which it engages its associated slider upon movement of said member, means normally moving said coupling elements to inactive positions and means for selectively moving said coupling elements to operative positions.

3. In a merchandising machine having a plurality of rotary merchandise carriers each of which is provided with a plurality of article receiving compartments and each of which is supported for movement around a generally horizontal axis and each of which is adapted to be driven to position a compartment thereof adjacent to a location at which an article can move out of the compartment, improved drive system for selectively rotating said carriers including a drive member, means mounting said drive member for vertical linear reciprocating movement adjacent to said carriers, a plurality of sliders, means mounting said sliders for movement adjacent to said carriers, respective drag links on said sliders, means on each drag link for moving its associated carrier upon operation of the associated slider, respective normally inoperative interengageable means on said sliders and on said member, and means for selectively rendering said interengageable means operable.

4. In a merchandising machine having a plurality of rotary merchandise carriers each of which is provided with a plurality of article receiving compartments and each of which is supported for movement around a generally horizontal axis and each of which is adapted to be driven to position a compartment thereof adjacent to a location at which an article can move out of the compartment, an improved drive system for selectively rotating said carriers including a drive member, means mounting said drive member for vertical linear reciprocating movement adjacent to said carriers, and respective selectively actuatable means for coupling said member to said carriers.

5. In a merchandising machine having a plurality of rotary merchandise carriers each of which is provided with a plurality of article receiving compartments and each of which is supported for movement around a generally horizontal axis and each of which is adapted to be driven to position a compartment thereof adjacent to a location at which an article can move out of the compartment, an improved drive system for selectively rotating said carriers including a drive member, means mounting said drive member for vertical linear reciprocating movement adjacent to said carriers, respective pairs of interengageable elements associated with said carrier, means mounting one element of each pair on said member, means mounting the other members of said pairs respectively adjacent to said carriers, a first element of each pair being mounted for movement between a first position at which it will be engaged by the second element in response to the initial stroke of said member and a second position at which it will clear said second element in the course of the initial stroke of said member, means normally positioning said first elements in said second position, and means for selectively moving said first elements to said first position.

6. In a merchandising machine having a cabinet and a rotary merchandise carrier provided with a plurality of storage compartments and adapted to be driven to position a compartment thereof adjacent to a location at which an article can move out of said storage compartment and means mounting said carrier for movement between a house position is said cabinet and a loading position at which said carrier extends out of said cabinet and a pusher adapted to be moved into a compartment positioned adjacent to said location, an improved drive system including a drive member, means mounting said drive member for linear reciprocating movement on said cabinet, means for driving said member and means including a slider on said carriage, mounting means responsive to movement of said drive member in the home position of said carrier, a drag link on said slider, an element on said drag link adapted to move along a first path in which it sequentially rotates said carrier and moves said pusher and a second path in which it ensures return of a pusher and clears a carrier and means for constraining said element to move along said first path in the course of the initial stroke of said member and along the second path in the course of the return stroke of said member.

7. In a merchandising machine having a cabinet and a display escrow assembly adapted to be actuated to deliver an article held thereby and a rotary merchandise carrier provided with a plurality of storage compartments and adapted to be driven to position a compartment thereof adjacent to said escrow assembly to which an article can move out of said storage compartment and means responsive to rotation of said carrier for actuating said escrow assembly and means mounting said carrier for movement between a housed position in said cabinet and a loading position at which said carrier extends out of said cabinet and a product pusher adapted to be moved into a compartment positioned adjacent to said escrow assembly means, an improved drive system including a drive member, means mounting said drive member for linear reciprocating movement on said cabinet, means for driving said member and means on said carriage mounting means responsive to movement of said drive member in the home position of said carrier for sequentially rotating said carrier and moving said product pusher, said member driving means driving said member with a forward stroke including a dwell between the time said carrier is rotated and said pusher is moved.

8. In a merchandising machine having a cabinet and a rotary merchandise carrier provided with a plurality of storage compartments and adapted to be driven to position a compartment thereof adjacent to a location at which an article can move out of said storage compartment and means mounting said carrier for movement between a housed position in said cabinet and a loading position at which said carrier extends out of said cabinet, an improved drive system including a drive member, means mounting said drive member for linear reciprocating movement on said cabinet, means for driving said member and means including a slider on said carriage mounting means responsive to movement of said drive member in the home position of said carrier, a drag link on said slider, interengageable means on said link and on said carrier and means for engaging said interengageable means in the course of the initial stroke of said member for rotating said carrier and for inhibiting engagement of said interengageable means during the return stroke of said member.

9. In a merchandising machine having a cabinet and a rotary merchandise carrier provided with a plurality of storage compartments and adapted to be driven to position a compartment thereof adjacent to a location at which an article can move out of said storage compartment and means mounting said carrier for movement between a housed position in said cabinet and a loading position at which said carrier extends out of said cabinet, an improved drive system including a drive member, means mounting said drive member for linear reciprocating movement on said cabinet, means for driving said member and means including a slider on said carriage mounting means responsive to movement of said drive member in the home position of said carrier for rotating said carrier.

10. In a merchandising machine having a cabinet and a rotary merchandise carrier provided with a plurality of storage compartments and adapted to be driven to position a compartment thereof adjacent to a location at which an article can move out of said storage compartment and means mounting said carrier for movement between a housed position in said cabinet and a loading position at which said carrier extends out of said cabinet, an improved drive system including a drive member, means mounting said drive member for linear reciprocating movement on said cabinet, means for driving said member and means on said carriage mounting means responsive to movement of said drive member in the home position of said carrier for rotating said carrier.

* * * * *

UNITED STATES PATENT AND TRADEMARK OFFICE

CERTIFICATE OF CORRECTION

PATENT NO. : 4,176,762

DATED : December 4, 1979

INVENTOR(S) : Frank T. Scalera and Merrill Krakauer

It is certified that error appears in the above-identified patent and that said Letters Patent are hereby corrected as shown below:

Column 9, line 67, after "plurality" insert -- of --;

Column 11, line 1, change "is" to -- in --.

Signed and Sealed this

*Eleventh* Day of *March 1980*

[SEAL]

*Attest:*

SIDNEY A. DIAMOND

*Attesting Officer*

*Commissioner of Patents and Trademarks*